US007786693B2

(12) United States Patent
Schmitz et al.

(10) Patent No.: US 7,786,693 B2
(45) Date of Patent: Aug. 31, 2010

(54) METHOD FOR BRAKING A RUNNING METAL STRIP AND UNIT FOR CARRYING OUT THE METHOD

(76) Inventors: Eckard Schmitz, Byfangerstr, 10a, D-59077 Hattingen (DE); Volker Wandelt, In der Dördel 14, D-59077 Hamm (DE)

( * ) Notice: Subject to any disclaimer, the term of this patent is extended or adjusted under 35 U.S.C. 154(b) by 534 days.

(21) Appl. No.: 11/793,177

(22) PCT Filed: Dec. 6, 2005

(86) PCT No.: PCT/DE2005/002199

§ 371 (c)(1),
(2), (4) Date: Jun. 14, 2007

(87) PCT Pub. No.: WO2006/063559

PCT Pub. Date: Jun. 22, 2006

(65) Prior Publication Data

US 2009/0026303 A1 Jan. 29, 2009

(30) Foreign Application Priority Data

Dec. 16, 2004 (DE) ..... 10 2004 061 174
Aug. 1, 2005 (DE) ..... 10 2005 036 570

(51) Int. Cl.
*H02P 3/04* (2006.01)

(52) U.S. Cl. ..... 318/765; 242/324; 242/370

(58) Field of Classification Search ..... 318/269, 318/362, 430, 434, 614, 757, 759, 765; 242/324, 242/370, 410, 419.3; 188/161, 163
See application file for complete search history.

(56) References Cited

U.S. PATENT DOCUMENTS

| | | | | |
|---|---|---|---|---|
| 2,731,212 | A * | 1/1956 | Baker | 242/419.3 |
| 3,380,686 | A * | 4/1968 | Gaudin | 242/419.3 |
| 3,433,398 | A * | 3/1969 | Moore et al. | 226/93 |
| 3,723,795 | A * | 3/1973 | Baermann | 310/93 |
| 3,824,516 | A * | 7/1974 | Benowitz | 335/284 |
| 3,826,442 | A * | 7/1974 | Bethke | 242/418.1 |
| 4,792,075 | A * | 12/1988 | Umlauf | 226/172 |
| 4,915,318 | A * | 4/1990 | Morrison | 242/419 |
| 5,346,155 | A * | 9/1994 | Alexander et al. | 242/334 |
| 6,019,200 | A * | 2/2000 | Janzen et al. | 188/163 |
| 6,148,967 | A * | 11/2000 | Huynh | 188/164 |
| 6,176,355 | B1 * | 1/2001 | Yamamoto | 188/267 |
| 6,478,126 | B2 * | 11/2002 | Drecq | 188/264 D |
| 6,585,140 | B2 * | 7/2003 | Umlauf | 226/172 |
| 6,698,554 | B2 * | 3/2004 | Desta et al. | 188/158 |
| 6,725,982 | B2 * | 4/2004 | Tani et al. | 188/164 |

* cited by examiner

*Primary Examiner*—Bentsu Ro
*Assistant Examiner*—Antony M Paul

(57) ABSTRACT

The method and unit for braking a metal strip (1), running off a wind-out coiler (2.1) in the form of a coil (1.1) and running onto a wind-on coiler (2.2) again, are to guarantee that a surface of the metal strip remains undamaged and a full effective braking force is exerted on the metal strip (1) by means of an eddy current brake (3.1) with a rotating magnet system (3.2). The above is achieved, whereby the braking force is exerted on the metal strip (1) by means of an induced counter-torque against a support bearing (4) to one side in a non-contact manner, whereby the support bearing (4) may be embodied as a counter roller (4.1).

19 Claims, 4 Drawing Sheets

METHOD FOR BRAKING A RUNNING METAL STRIP AND UNIT FOR CARRYING OUT THE METHOD

TECHNICAL FIELD

The invention relates to a method for braking a metal strip which runs off from an unwinding reel and runs onto a winding-up reel again. The invention also relates to a unit for carrying out the method, in which unit the braking is performed by means of an eddy-current brake. In this case, the eddy currents to be induced are generated by a rotating magnet system.

PRIOR ART

During the lengthwise division of a rolled metal strip using circular blade cutters, it is known to use braking assemblies which are arranged downstream of the circular blade cutters in the running direction of the strip and which, if required, brake the running metal strip by means of frictional force and in as slip-free a manner as possible.

In known units for lengthwise division of a strip, the braking assembly comprises a main brake and/or a preliminary brake. The main brake comprises groups of individually braked rings around which the sections, which are divided lengthwise, of the strips are wrapped in the manner of an S-shaped set of rollers. A preliminary brake is also provided in order to transmit a braking torque from these braking rings onto the sections. A suitable preliminary brake is an eddy-current brake. However, to date eddy-current brakes have the disadvantage that they can apply a sufficient braking action only in the case of highly conductive metal strips such as aluminum or non-ferrous metal.

In a known unit for lengthwise division of strips according to DE-A 23 06 029 for the lengthwise division of a rolled metal strip, a two-stage braking assembly was arranged downstream of a cutter fitted with circular blade disks. This assembly has disadvantages and exhibits increased wear, does not prevent the surfaces of the metal strip from being scratched and does not provide sufficient lateral guidance for the metal strip.

In order to eliminate these disadvantages, the invention according to DE 195 40 748 C2 aims to provide a unit for the lengthwise division of strips with braking means, in which pressure-exerting means act on the sections in the wrapping region of the braking rings, said pressure-exerting means acting on the sections in a slip-free manner either without contact or with contact on the side facing away from the braking rings, both with and without transmission of a braking force.

The present invention aims to preclude this approach on account of the relatively complicated elements of the braking assembly and instead examine the extent to which following the operating principle of the eddy-current brake leads to a usable solution for braking running metal strips.

Analysis of the implemented prior art shows that attempts have already been made, in accordance with the teaching as per DE 195 24 289 C2, to design an apparatus for braking electrically conductive strips by means of eddy-current effects, in which the magnetic field-generating device comprises at least one magnet roller which can rotate in the opposite direction to the conveying direction.

Although this solution appears to be heading in the right direction, it prevents technically/technologically usable implementation at the same time due to the further refinements, such as assignment of a further magnet roller to the lower face of the strip at a distance, variable distance of the magnet rollers, magnet rollers with electromagnets.

In practice, it has disadvantageously been found that contactless introduction of the braking torques by the induced eddy currents from rotating magnet rollers cannot exert any actual braking action. The (variable and, on account of the eddy currents, also varying) distance of the magnet rollers prevents the effective introduction of braking torques.

This is demonstrated by the following effects:

When a magnet roller is used, the problem arises that the strip is pushed out of the magnetic field and the eddy-current brake is ineffective. If, in contrast, two magnet rollers are provided, the magnet systems influence one another (possibly with disadvantageous heating), as a result of which no mechanical force can be transmitted to the strip and rotation may even occur in the longitudinal direction and, given a small distance, the strip rubs against the magnet roller and also, given a large distance, a braking action is likewise not transmitted.

Therefore, the problem of wanting to manage without additional braking means is not solved by the use of magnet rollers as opposed to static eddy-current generators.

Even developing the teaching, according to the patent, of DE 195 24 289 C2, for example with regard to the lower second magnet roller, no approach can be found for avoiding the described problems and disadvantages; instead, this is accompanied by the lower magnet roller acting as a virtual abutment face on account of the tendency of the strips to rotate about the axis in the conveying direction and not fulfilling the intended function anyway.

Furthermore, the use of two magnet rollers shows, with regard to the variable distance, that, given a small distance, the strip may be damaged and, given a large distance, an effective braking force is not applied and/or an oversized magnet system is required, on account of the excessively small magnetic field.

SUMMARY OF THE INVENTION

The object of the invention is therefore to provide a method and a unit for braking a metal strip, which runs off from an unwinding reel as a coil and runs onto a winding-up reel again, by means of a braking assembly with an eddy-current brake as a rotating magnet system, which unit firstly ensures that the surface of the metal strip is not damaged and secondly exerts a braking force on the metal strip with full effect. In this case, additional brakes should be dispensed with, the unit should be of simple design overall and the braking action should be performed on one side in a contactless fashion. The intention is for the current, which is induced in the magnetic field by the magnetic alternating field in the metal strip to be braked (as an electrical conductor), to generate a counter-torque on the metal strip; it was previously not possible to use this action as a braking torque for units of the type mentioned in the introduction without disadvantages.

According to the invention, this is achieved in accordance with the method having the features of claims 1 to 12. A unit which exhibits the features of claims 13 to 25 is proposed for carrying out the method.

Even if the invention with the rotating magnet system uses the part of a principle already disclosed according to DE 195 24 289 C2, the present inventive measure is not suggested. A usable solution can be realized only on account of the invention in a surprising and effective manner by means of the principle of a contact-making abutment as a mating roller which is arranged beneath the metal strip.

To date, it has not been possible to generate, in a practical and space-saving manner without further braking assemblies, an effective counter-tension with a complete braking action on the metal strip on account of the counter-torque induced from the torque of the eddy current solely with a rotating magnet system: the solution according to DE 195 24 289 C2 had to be abandoned.

Overall, the following advantageous features and effects, which are related to the above-described invention and likewise cannot be found in the teaching of the prior art closest to the present invention, can be used:

1. The abutment, by means of the mating roller, forces contactless braking on one side. In contrast, according to the cited prior art, the strip attempts, as a result of the magnetic field (braking force) acting on the strip in the vertical direction, firstly to remove itself from the magnet roller and thus leave the magnetic field, and secondly the metal strip is always located in the magnetic field, and this circumstance is very problematical specifically at slow strip speeds and ultimately has not ensured the practical use of the braking system to date.
   - The use of the adjustable mating roller (the distance between the strip and magnet roller can be set) can quickly and precisely vary the effective magnetic field of the eddy-current brake on the metal strip to be braked.
   - In this case, a setting range of 0-100% of the maximum available magnetic field can be utilized.
   - This option means that both the braking force and heating of the metal strip can be matched to any desired operating parameter.
   - The prior art disclosed to date does not provide this option.
   - The mating roller according to the invention prevents this and generates a corresponding counter-force, which mainly initially ensures the function of the use of a magnet roller for exerting braking forces.
   - Furthermore, the mating roller should be composed of electrically non-conductive and magnetically impermeable material so as to support this function.
   - According to the invention, the braking force can additionally also be controlled by means of the physical variation (distance) of the mating roller in relation to the magnet roller (here the rotating magnet system).
   - At the same time, the vertical force smoothes the metal strips which are to be braked and tend to rotate and thus permits the air gap between the rotating magnet system and the strip to be minimized, as a result of which, in addition to the effective braking action, a correspondingly small and compact construction is rendered possible.
2. The main closed-loop control of the rotational speed for controlling the braking force is performed by a frequency converter setting the rotational speed of the rotating pole system.
3. The braking force is controlled by a closed control loop by means of using measurement sensors for measuring strip tension and forming a control loop with the frequency converter of the motor for the rotating magnet system which is fitted exclusively with permanent magnets. It is therefore possible to set the required braking force accurately and simply by means of open-loop control.
4. In contrast to the prior art, the invention provides a casing around the rotating magnet system for absorbing the centrifugal forces of the permanent magnets and not, as according to the cited prior art, the disadvantageous casing which is composed of non-conductive material (plastic). The casing ensures that the produced centrifugal forces of the roller fitted with permanent magnets and not electromagnets is absorbed by the rotation of the magnet system at a high rotational speed. In this case, the casing material may be electrically conductive but not magnetically permeable.
5. The edge on the rotating magnet system ensures that tangential forces which act on the individual permanent magnets which are located on the pole drum are absorbed. Said edge prevents displacement of the individual magnet segments and ensures long-term functioning of the braking system.

The invention which is therefore provided in a complex respect can be used both for simple unwinding/winding-up units for metal strips and also for units for lengthwise division of the type described in the introduction.

The previous disadvantages of eddy-current brakes in any case, and the non-operation of rotating magnet systems as eddy-current braking systems in particular, are eliminated by the invention. Eddy-current braking by means of rotating magnet systems can therefore also take over the function of a single main brake, without having to act only as a preliminary brake.

BRIEF DESCRIPTION OF THE DRAWINGS

The invention is explained in greater detail using an exemplary embodiment. In the drawings

BEST WAY OF IMPLEMENTING THE INVENTION

Figure 1:
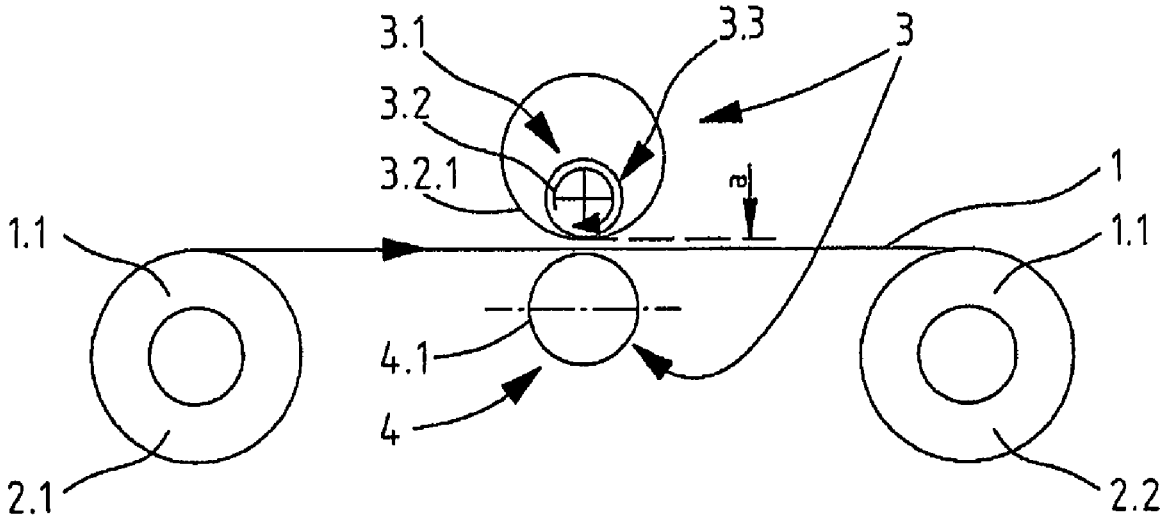
FIG. 1 shows a schematic illustration of a side view of a unit according to invention with an eddy-current brake as a rotating magnet system and a mating roller as an abutment.

FIG. 1 schematically shows a unit for lengthwise division (without illustrating the severing devices, such as circular blade cutters, which may be required), in which a metal strip 1 runs from an unwinding reel 2.1 which holds a coil 1.1 onto a winding-up reel 2.2.

In order to brake the metal strip 1, a braking assembly 3 is provided as an eddy-current brake 3.1 which uses a rotating magnet system 3.2 whose speed can be set and which is arranged above the metal strip 1 on one side in a contactless fashion. A counter-torque which is able to deploy the fully required braking force on its own is now generated in the running metal strip 1 by the rotating magnet system 3.2 as a result of the current induced by the magnetic field.

A prerequisite for this is that an abutment 4 for counteracting the deviation or ensuring a (contactless) distance a of the metal strip 1 in relation to the rotating magnet system 3.2 is provided beneath the metal strip 1. According to FIG. 1, this abutment 4 is formed as a mating roller 4.1 according to the invention which is composed of an electrically non-conductive and magnetically impermeable material.

The rotation speed of the rotating magnet system 3.2 can be set. In order to realize all the action options of the rotating magnet system 3.2 as a braking assembly, the physical position of said rotating magnet system in relation to the metal strip 1 can be adjusted.

An optional variant of the invention may also involve the rotating magnet system 3.2 being surrounded by a respective drum (roll casing) 3.2.1, with the magnet system 3.2 being driven at a high speed and a higher speed than that of the drum 3.2.1.

In this case, it is possible to steplessly set the rotating magnet system 3.2 in the drum 3.2 in an eccentric manner, about the center point of the respective drum 3.2.1, such that it can pivot and/or such that it can be radially adjusted, and to provide the distance up to a contactless distance between the magnet system 3.2 and the drum 3.2.1 in a steplessly set manner.

Figure 2:
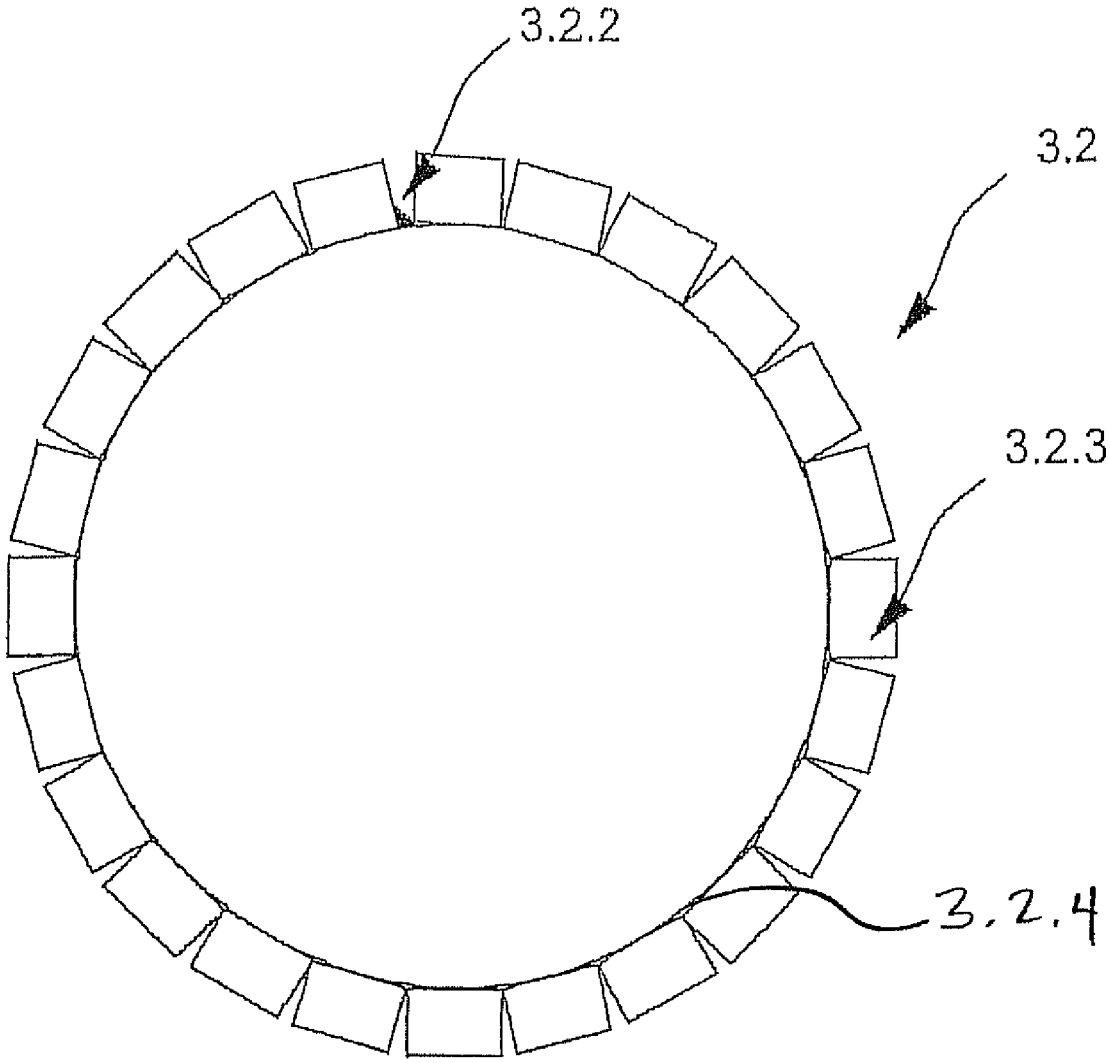
FIG. 2 shows a detail of the unit according to FIG. 1 with a schematic illustration of the edge on the rotating magnet system.

According to FIG. 2, an edge 3.2.2 is provided in order to absorb the tangential forces of the rotating magnet system 3.2 which is fitted exclusively with permanent magnets 3.2.3.

As can be seen from FIG. 1, a VA casing 3.3 for absorbing the centrifugal forces acting on the permanent magnets 3.2.3 is provided around the rotating magnet system 3.2.

Figure 3:
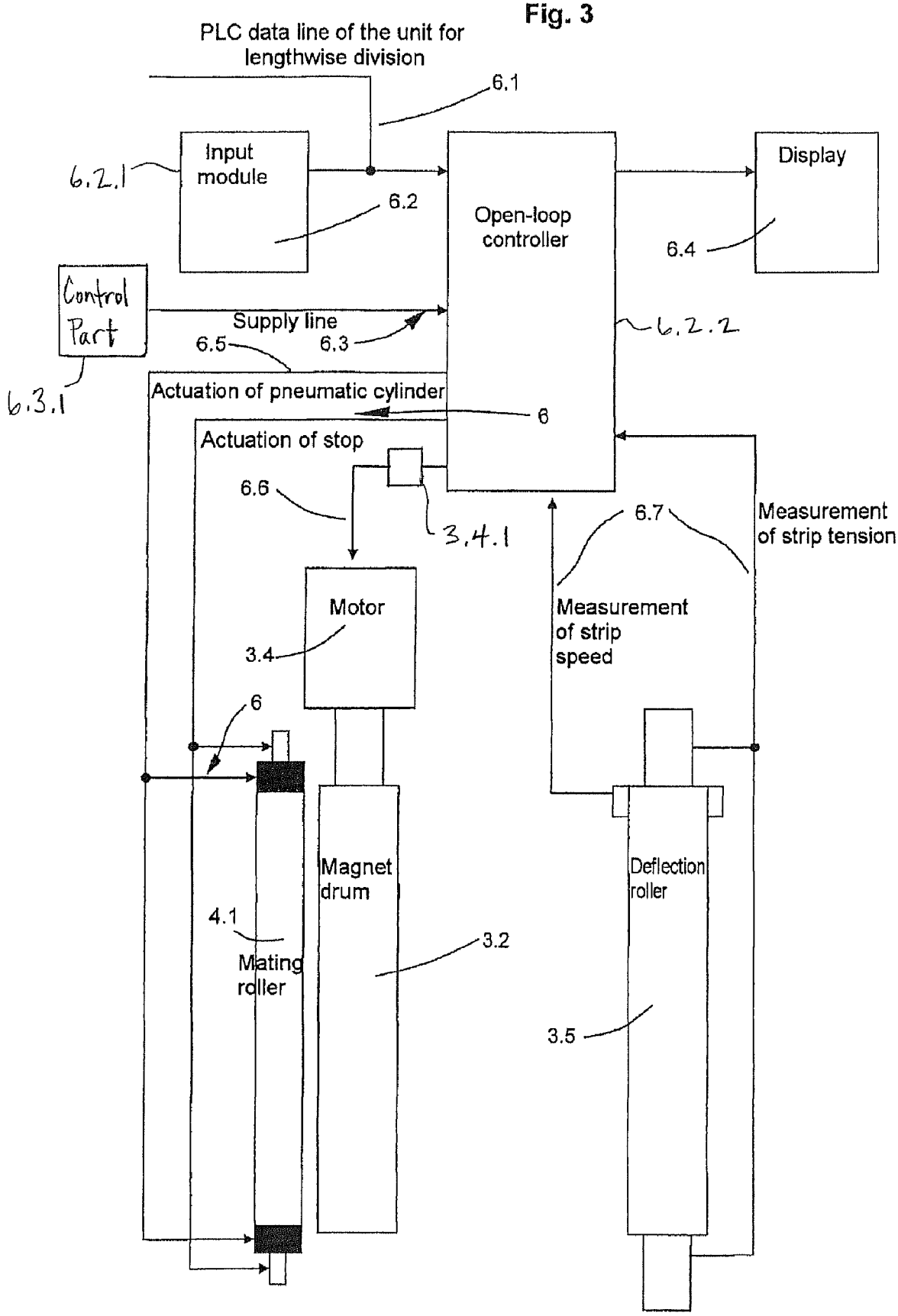
FIG. 3 shows a schematic illustration of the unit according to FIG. 1 with the control block and its links.
Figure 4:
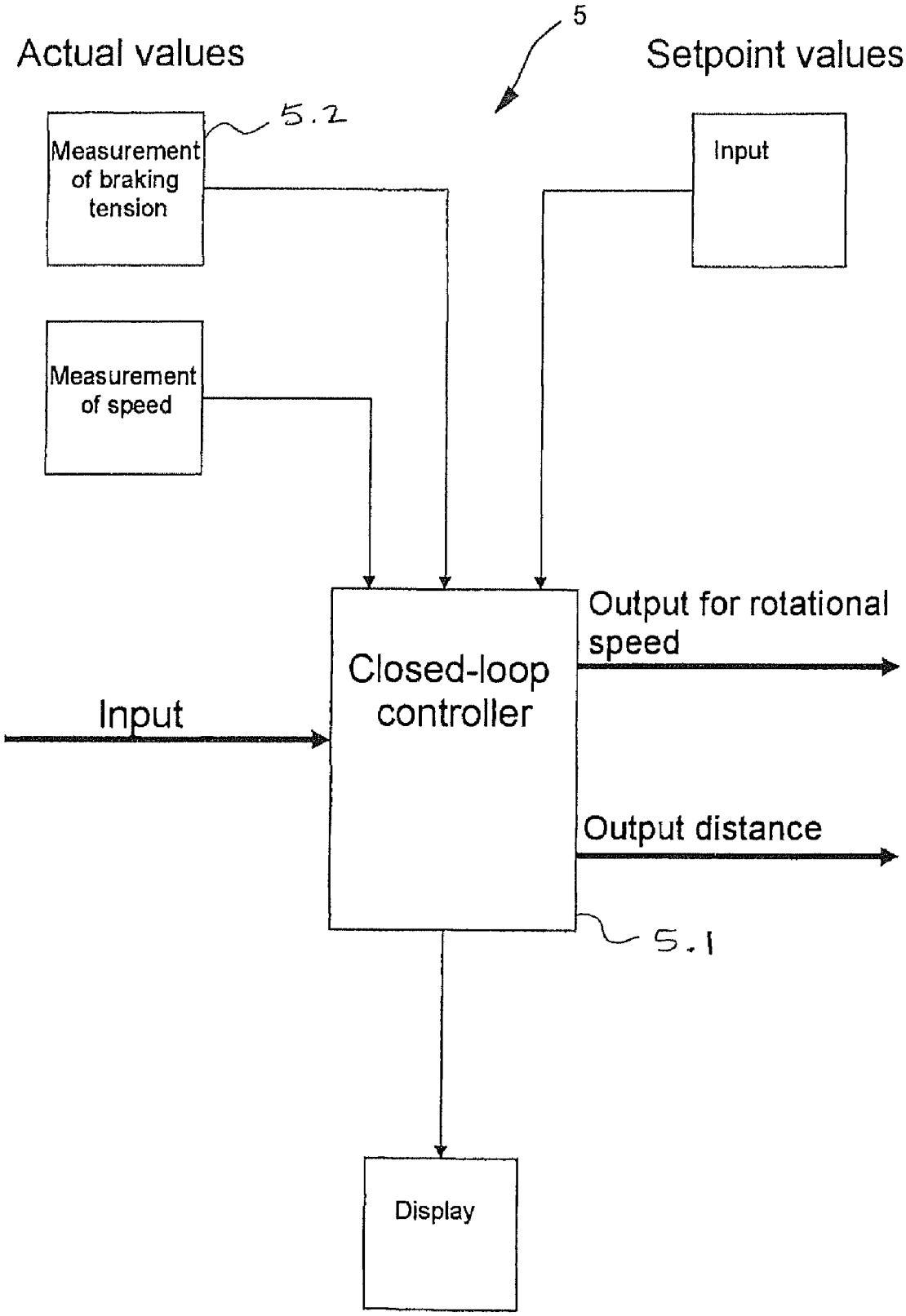
FIG. 4 shows the control loop as a simple block diagram.

A frequency converter (not illustrated), a control loop 5 corresponding to FIG. 4 and, according to FIG. 3, measurement of the strip tension/braking force and means 6 for varying the distance a of the abutment 4/mating roller 4.1 are provided, which have A frequency converter (not illustrated), a control loop 5 corresponding to FIG. 4 and, according to FIG. 3, measurement of the strip tension/braking force and means 6 for varying the distance a of the abutment 4/mating roller 4.1 are provided, which have a) a PLC data line 6.1,
b) an input module 6.2,
c) a control part 6.3.1 with a supply line 6.3 and a display 6.4 for displaying data,
d) first actuation 6.5 of the means 6 for varying the distance a of the abutment 4/the mating roller 4.1,
e) second actuation 6.6 of a motor 3.4 of the rotating magnet system 3.2, and
f) lines 6.7 for the measurement of the speed of the metal strip 1 and of the strip tension/braking force on a deflection roller 3.5.

With this embodiment of a unit, the method according to the invention can attain the used eddy-current brake 3.1 as a main brake. The entire braking action is generated solely by the rotating magnet system 3.2 by means of the mating roller 4.1 and exerted on the running metal strip 1 as a countertorque.

Overall, the disadvantages of the prior art described in the introduction, such as scratching of the surfaces of metal strips, for example in the case of anodized aluminum strips, are eliminated because the braking action firstly can be set on one side in a contactless fashion and can be exerted with full effect on the metal strip 1 without S-shaped wrapping-around means and secondly is generated solely by the rotating magnet system 3.2 by means of the mating roller 4.1.

Furthermore, the method is executed such that the braking action can be set and therefore also can be controlled by the rotation speed of the respective magnet system 3.2 independently of the speed of the metal strip 1.

In accordance with the claims, other forms of the method can also be implemented.

According to the method, this can be performed by the local adjustment of the respective magnet system 3.2 independently of the speed of the metal strip 1. In the process, the local adjustment of the respective abutment 4.1 can also be set or controlled independently of the speed of the metal strip 1.

The method and the unit according to the invention provide the option of using the rotating magnet system 3.2 to implement a computer-assisted program for the open-loop control or rather closed-loop control of braking of the rolled metal strip 1, which program optionally or cumulatively comprises the program steps input/recording/output of data for setting the speed of the metal strip,
input/recording/output of data for setting the braking action of the rotating magnet system 3.2,
input/recording/output of data for setting the rotation speed of the magnet system 3.2,
input/recording/output of data for adjusting the local position of the magnet system 3.2,
input/recording/output of data for setting the air gap a between the magnet system 3.2 and the abutment 4,
input/recording/output of data from the dimensions of the coils 1.1 and/or
input/recording/output of data for adjusting the local position of the abutment 4.

In this case, the control loop 5 can be used which, in accordance with FIG. 4, has the functions a) recording/input of the actual values from a braking-tension measurement and/or speed measurement of the metal strip 1,
b) input of required setpoint values,
c) output of a rotational-speed value for the rotating magnet system 3.2,
d) output of a distance value a for the rotating magnet system 3.2 in relation to the metal strip 1,
e) display of the control values on a display 6.4.

The method uses the frequency converter for setting the rotational speed of the rotating magnet systems 3.2.

The method is formed by a) a preselection program with data calculation from the entered values of thickness, width, material, number of items and/or desired strip tension/braking force of the metal strip 1 for determining the distance a of the mating roller and the rotational speed of the rotating magnet system 3.2,
b) closed-loop control of the frequency converter while the metal strip 1 is running by measuring the strip tension/braking force, and
c) reducing the strip tension/braking force by changing the distance a and/or the rotational speed starting from a strip speed<the entered speed.

Finally, it is therefore possible, in practice, to control the induced braking force by fine adjustment of the rotational speed of the pole drum 3.2.4 of the rotating magnet system 3.2, it being possible to variably set the rotational speed by means of the frequency converter.

The distance of the mating roller 4.1 in relation to the rotating magnet system 3.2 can likewise be variably set after the presetting operation by means of an electromotive apparatus (not illustrated).

The preselection program according to the claims integrates a data calculation from the input of strip thickness, strip width, material, number of items and desired strip tension in order to determine the distance of the mating roller 4.1 and/or the frequency (rotational speed) of the rotating magnet system 3.2. Therefore, the frequency, for example, would have to be changed if it is outside the range of 40-60 Hz.

After the unit is started (beginning of production), the frequency converter is controlled by measuring the strip tension. In this case, the restraint tension corresponds to a reduction in the braking force/strip tension by changing the distance and/or the rotational speed starting from a strip speed which is less than the tip speed (for example, approximately 10 m/min). This provides the advantage of less heating of the metal strips 1 by the rotating magnet system.

The open-loop controller 6.2.2 comprises the frequency converter and the closed-loop control system 5.1 with the strip-tension sensor 5.2, the PLC 6.1, the open-loop control means, for example a pneumatic means 6 for setting the mating roller 4.1, the input module 6.2 when data is interchanged with the main controller (not illustrated) of the unit (definition as interface), as a result of which no separate input module is required.

A dedicated switchgear cabinet 6.2.1 is feasible, in which the inputs provided are the input module 6.2 with data interchange, a supply line (power supply), a measurement line for strip-tension sensors and a measurement line for the strip speed. Outputs are provided to pneumatic valves 3.4.1, to the actuating motor and to the supply line for the motor 3.4. The input data (as setpoint values) and the measurement data (as actual values) appear on the display which displays information.

INDUSTRIAL APPLICABILITY

Compared to the solution according to DE 195 24 289 C2, which, however, constitutes an apparatus for braking electrically conductive strips by means of eddy-current effects which cannot be used in practice because a further magnet roller which can rotate in the opposite direction to the conveying direction was assigned to the magnetic field-generating device, the invention, according to which an abutment 4 for counteracting the deviation or ensuring a (contactless) distance a of the metal strip 1 in relation to the rotating magnet system 3.2 is provided beneath the metal strip 1, presents a solution which has proven successful in practical tests and functions in a surprisingly simple manner.

The invention claimed is:

1. A method for braking a metal strip, comprising:

providing an unwinding reel and a winding-up reel;

running the metal strip off from the unwinding reel as a coil;

running the metal strip onto the winding-up reel;

providing a braking assembly having an eddy-current brake having a rotating magnet system for generating a braking action on the metal strip and an abutment;

wherein the eddy-current brake remains apart from the metal strip in a contactless fashion;

running the metal strip through the braking system;

supporting the metal strip with the abutment as the metal strip runs through the braking system; and generating an eddy-current with the rotating magnet system for causing a braking action against the metal strip.

2. The method as claimed in claim 1, wherein the metal strip is subjected at least to lengthwise division.

3. The method as claimed in claim 1, wherein the braking action is set by the rotation speed of the magnet system independently of the speed of the metal strip.

4. The method as claimed in claim 1, wherein the braking action is set by the local adjustment of the magnet system independently of the speed of the metal strip.

5. The method as claimed in claim 1, wherein the braking action is set by the local adjustment of the mating roller independently of the speed of the metal strip.

6. The method as claimed in claim 1, wherein the braking action is set by the local adjustment of the respective magnet system within a drum independently of the speed of the metal strip.

7. The method as claimed in claim 1, further comprising the step of:

providing a computer-assisted program for an open-loop/closed-loop control of braking of the rolled metal strip, the computer-assisted program having at least one of the following program steps:

input/recording of data for setting the speed of the metal strip;

input/recording/output of data for setting the braking action of the rotating magnet system;

input/recording/output of data for setting the rotation speed of the magnet system;

input/recording/output of data for adjusting the local position of the magnet system;

input/recording/output of data for setting the air gap as a distance between the rotating magnet system and the metal strip;

input/recording/output of data from the dimensions of the coils; and input/recording/output of data for adjusting a local position of the abutment.

8. The method as claimed in claim 1, further comprising the step of:

providing a computer-assisted program having at least one of the following functions:

recording/input of the actual values from a braking-tension measurement and/or speed measurement of the metal strip;

input of required setpoint values;

output of a rotational-speed value for the rotating magnet system;

output of a distance value for the rotating magnet system in relation to the metal strip; and display of the control values on a display.

9. The method as claimed in claim 1, further comprising the step of:

providing a frequency converter for setting the rotational speed of the rotating magnet system.

10. The method as claimed in claim 9, further comprising the steps of:

providing a preselection program for receiving values for at least one of the following parameters of the metal strip:

thickness;

width;

material;

number of items;

desired tension; and desired braking force;

determining a distance of the mating roller or the rotational speed of the rotating magnet system with preselection program;

controlling the frequency converter while the metal strip is running by measuring the tension or the braking force; and changing the tension or the braking force by changing the distance of the mating roller or the rotational speed of the rotating magnet system.

11. A unit for braking a metal strip, comprising:

an unwinding reel;

a coil operably associated with the unwinding reel;

a winding-up reel; and a braking assembly having:

an eddy-current brake; and an abutment;

wherein the metal strip passes between the eddy-current brake and the abutment; and wherein the metal strip comes into contact with the abutment and remains apart from the eddy-current brake in a contactless fashion.

12. The unit as claimed in claim 11, wherein the eddy-current brake is a rotating magnet system arranged in a contactless fashion in relation to the metal strip.

13. The unit as claimed in claim 12, wherein the rotating magnet system is arranged so as to pivot about a center point of a drum.

14. The unit as claimed in claim 12, wherein the rotating magnet system is configured for radial adjustment.

15. The unit as claimed in claim 12, wherein a distance may be set in a stepless manner as a contactless distance between the rotating magnet system and the drum.

16. The unit as claimed in claim 12, further comprising:

an edge on the rotating magnet system for absorbing tangential forces of permanent magnets.

17. The unit as claimed in claim 12, further comprising:

a casing operably associated with the rotating magnet system for absorbing centrifugal forces.

18. The unit as claimed in claim 12, further comprising:

a control system comprising:

a frequency converter;

a control loop;

a means for measuring the tension of the metal strip and the braking force; and a means for varying the distance between the abutment and the eddy-current brake.

19. The unit as claimed in claim 18, further comprising:

a PLC data line;

an input module;

a control part having a supply line and a display for displaying data;

a first actuator for actuating the means for varying the distance between the abutment and the eddy-current brake;

a second actuator for actuating a motor of the rotating magnet system; and lines for measuring the speed of the metal strip, the tension of the metal strip, and the braking force.

* * * * *